US010196161B2

(12) United States Patent
Broadbent et al.

(10) Patent No.: US 10,196,161 B2
(45) Date of Patent: Feb. 5, 2019

(54) METHOD FOR FILLING PHARMACEUTICAL CONTAINERS

(71) Applicant: VANRX PHARMASYSTEMS INC., Burnaby (CA)

(72) Inventors: Nick Broadbent, Vancouver (CA); Jeroen Immerzeel, Squamish (CA); Christopher Procyshyn, Surrey (CA); Ross M. Gold, North Vancouver (CA); Steve Sang Joon Park, Toronto (CA)

(73) Assignee: VANRX PHARMASYSTEMS INC., Burnaby (CA)

( * ) Notice: Subject to any disclaimer, the term of this patent is extended or adjusted under 35 U.S.C. 154(b) by 0 days.

(21) Appl. No.: 15/719,736

(22) Filed: Sep. 29, 2017

(65) Prior Publication Data

US 2018/0127120 A1 May 10, 2018

Related U.S. Application Data

(62) Division of application No. 14/912,145, filed as application No. PCT/US2014/051223 on Aug. 15, 2014.

(Continued)

(51) Int. Cl.
*B65B 3/00* (2006.01)
*B65B 7/16* (2006.01)

(Continued)

(52) U.S. Cl.
CPC ..... *B65B 7/28* (2013.01); *B65B 3/003* (2013.01); *B65B 7/161* (2013.01); *B65B 7/2821* (2013.01);

(Continued)

(58) Field of Classification Search
CPC ..... B65B 7/161; B65B 7/2821; B65B 7/2828; B65B 7/2842; B65B 7/285; B65B 3/003;

(Continued)

(56) References Cited

U.S. PATENT DOCUMENTS 649,012 A 5/1900 Tapscott
898,458 A 9/1908 Goff (Continued)

FOREIGN PATENT DOCUMENTS

DE 102004035061 A1 * 2/2006 ..... B65B 3/003
EP 2192042 A1 6/2010

(Continued)

OTHER PUBLICATIONS

European Extended Search Report (PCT/US14/051223), dated Mar. 13, 2017.

(Continued)

*Primary Examiner* — Stephen F. Gerrity
*Assistant Examiner* — Joshua G Kotis
(74) *Attorney, Agent, or Firm* — Kevin R. Erdman; Brannon Sowers & Cracraft PC

(57) ABSTRACT

In one general aspect, a method for filling multiple containers with a pharmaceutical product is disclosed, which comprises decontaminating sealed nested materials in a transfer chamber, removing from the sealed nested materials one or both of a container nest holding the multiple containers and a closure nest holding multiple closures, transferring from the transfer chamber to a controlled environment enclosure the removed nest, aseptically filling the containers with the pharmaceutical product, and closing the containers with the multiple closures. The nests are configured to allow multiple closures and containers to be simultaneously aligned concentrically, and closed simultaneously. Spring-loaded retaining structures on the closure nest allow it to releasably retain (Continued)

multiple closures above the corresponding multiple containers. In some embodiments the spring-loaded features are monolithically integrated with the closure nest. The product may be lyophilized in partially sealed containers while the sealing closures are releasably retained by the closure nest.

48 Claims, 8 Drawing Sheets

Related U.S. Application Data

(60) Provisional application No. 61/867,014, filed on Aug. 16, 2013.

(51) Int. Cl.

| | |
|---|---|
| ***B65B 7/28*** | (2006.01) |
| ***B65D 1/02*** | (2006.01) |
| ***B65B 55/02*** | (2006.01) |
| ***B65B 55/04*** | (2006.01) |
| ***B65B 55/08*** | (2006.01) |
| ***B65B 55/10*** | (2006.01) |
| ***B65B 63/08*** | (2006.01) |
| ***B65D 51/00*** | (2006.01) |

(52) U.S. Cl.
CPC ..... *B65B 55/027* (2013.01); *B65B 55/04* (2013.01); *B65B 55/08* (2013.01); *B65B 55/10* (2013.01); *B65B 63/08* (2013.01); *B65D 1/0246* (2013.01); *B65D 51/00* (2013.01); *B65D 51/002* (2013.01)

(58) Field of Classification Search
CPC ..... B65B 3/006; B65B 31/02; B65B 31/025–31/028; B65B 55/025; B65B 55/027; B65B 1/46; B67B 1/03
USPC ..... 53/299, 425, 471, 485–490, 281–283
See application file for complete search history.

(56) References Cited

U.S. PATENT DOCUMENTS

| | | | | |
|---|---|---|---|---|
| 4,286,389 | A | 9/1981 | Ogle | |
| 4,628,969 | A * | 12/1986 | Jurgens, Jr. | A61L 2/07 134/169 R |
| 5,081,822 | A | 1/1992 | Boyd | |
| 5,519,984 | A | 5/1996 | Beussink | |
| 5,597,530 | A * | 1/1997 | Smith | A61L 2/07 134/150 |
| 5,816,772 | A * | 10/1998 | Py | A61G 10/005 414/806 |
| 6,109,139 | A | 8/2000 | Regester | |
| 6,164,044 | A * | 12/2000 | Porfano | B65B 55/10 422/28 |
| 6,418,982 | B1 | 7/2002 | Zhang | |
| 6,457,299 | B1 | 10/2002 | Schwenke | |
| 9,079,757 | B2 | 7/2015 | Bjork | |
| 2004/0139698 | A1* | 7/2004 | Grifols Lucas | A61L 2/07 53/426 |
| 2005/0060962 | A1 | 3/2005 | Rothbauer et al. | |
| 2005/0217211 | A1* | 10/2005 | Py | B29C 45/006 53/426 |
| 2006/0200968 | A1* | 9/2006 | Thilly | B29C 45/006 29/527.1 |
| 2008/0184671 | A1 | 8/2008 | Fleckenstein et al. | |
| 2008/0216312 | A1 | 9/2008 | Williams et al. | |
| 2008/0251473 | A1* | 10/2008 | Rebstock | H01L 21/67326 211/41.18 |
| 2009/0100802 | A1* | 4/2009 | Bush | A61M 5/002 53/434 |
| 2009/0223592 | A1* | 9/2009 | Procyshyn | B25J 21/00 141/2 |
| 2011/0030320 | A1 | 2/2011 | Blumenstock et al. | |
| 2011/0135535 | A1* | 6/2011 | Py | A61L 2/04 422/22 |
| 2011/0192756 | A1 | 8/2011 | Hill | |
| 2011/0289889 | A1 | 12/2011 | Kohanski et al. | |
| 2012/0090268 | A1 | 4/2012 | Krauss | |
| 2012/0248057 | A1* | 10/2012 | Bogle | A61J 1/1406 215/43 |
| 2015/0107190 | A1* | 4/2015 | Zambaux | B25J 21/02 53/287 |
| 2015/0122693 | A1* | 5/2015 | Deutschle | B65D 25/108 206/562 |

FOREIGN PATENT DOCUMENTS

| | | |
|---|---|---|
| EP | 2599721 B1 | 6/2013 |
| FR | 2049252 A5 | 3/1971 |

OTHER PUBLICATIONS

PCT International Preliminary Report on Patentability (PCT/US14/051223), dated Jan. 29, 2015.
PCT International Search Report (PCT/US14/051223), dated Mar. 26, 2015.

* cited by examiner

METHOD FOR FILLING PHARMACEUTICAL CONTAINERS

CROSS-REFERENCE TO RELATED APPLICATIONS

The present application is a Divisional of U.S. patent application Ser. No. 14/912,145, filed Feb. 15, 2016, which claims priority under 35 U.S.C § 371 of PCT Patent Application Number PCT/US2014/051223, filed Aug. 15, 2014, which claims benefit of U.S. Patent Provisional Application Ser. No. 61/867,014, filed Aug. 16, 2013, the disclosures of which are incorporated by reference herein.

BACKGROUND OF THE INVENTION

Field of the Invention

The present invention relates to a device, system and method for filling and sealing of pharmaceutical containers. In particular, it relates to a device, system and method for filling and sealing of pharmaceutical containers within a controlled environment chamber.

Description of the Related Art

By its very nature, the production of sterile pharmaceuticals by humans can be problematic. Humans can be a large source of microbial contamination. Also, with increased potencies, some drugs can be hazardous in occupational exposure. For at least these reasons, robotics is attractive in dosage manufacturing to limit human contact. Isolator technology, which provides a solid barrier between a process and humans, can also be used in dosage manufacturing to limit human contact.

Traditionally equipment for filling, stoppering and capping of pharmaceutical containers was designed to process singulated containers and typically employed vibratory bowls for the supply of elastomeric closures and shrink caps. More recently, equipment has become available to process multiple containers in nested arrangements. Such container arrangements can be cleaned, de-pyrogenated, and sterilized at the site of the container manufacturer. This simplifies the equipment requirements and operations of the pharmaceutical manufacturer.

A significant portion of all filling equipment is of such complexity that it cannot be integrated in a controlled environment enclosure. Such filling equipment can only be installed in a restricted access barrier system; which environment is much less secure than complete physical barrier provided by a controlled environment enclosure such as an isolator. The other negative aspect of complex equipment is cleanability, which can be a concern for multi-product use and in particular for highly potent products. In particular, systems employing conveyor belts to convey nested containers are known, and these present considerable challenges as regards cleaning to a degree acceptable in the pharmaceutical industry.

The handling and singulation of elastomeric stoppers and aluminum crimp caps is known to be problematic at times. Blockages of vibratory chutes cannot be prevented at all times and require operator interventions from time to time to free blockages. This has led to the use of nested pharmaceutical containers.

Some of the newer filling equipment accepts the nested containers, but then de-nests the containers to processes them in a singulated fashion, exactly as happens in the traditional equipment. They thereby forego some of the inherent benefits provided in the first place by the nesting of the containers. Other equipment variants de-nest the elastomeric closures and aluminum crimp caps before then applying them in singulated fashion.

It is good practice in automation not to let go of a part such as a pharmaceutical container or closure once it is properly held and to only let go of the part once any processing involving the part is completed. Most prior art vial filling machine designs deviate from this rule, because of perceived difficulties in placing of stoppers and caps when containers are located in a nest.

Another good practice is to avoid unnecessary handling of parts under aseptic conditions. Stopper and closure elements are typically singulated in industry using vibratory bowls and transported using vibratory chutes. The vibratory bowl and chutes contact the stoppers, the surfaces of which will eventually be in direct contact with the product inside the container. To address this problem, it is generally considered necessary to steam sterilize the vibratory bowls and chutes. However, is practically impossible to transfer the stopper bowl and chutes aseptically from the sterilizing autoclave to the processing environment.

As regards the design of particular closure nests, an example of a prior art vial closure nest is described in US 20120248057 A1. The particular example is limited in practical applications for at least three reasons.

Firstly, commercially available trays typically have 60-120 containers, the quantity varying with vial diameter. The packing density of 60-120 containers with a foot print of 8"×9" in a nest does not allow for a matching cap nest design as shown in US 20120248057 A1, because its holding features take up too much space. The force required for capping for each vial is typically in the range of 40-50N, and is therefore an order of magnitude larger than the force required for removal of the tamper evident feature shown in the same patent application.

Secondly the closure has to be held by the nest in such a way that the force required for capping of the vial is directed without a resulting force vector acting on the tamper evident feature. When considering simultaneous capping, the forces can add up to 6000N, further stressing the need for a closure nest design that does not distort or flex under load.

Thirdly, the closure needs to be held in the nest in such a way that its accidental release is prevented during transport and handling; yet it should allow for the cap to be removed without risk of removing the tamper evident feature.

In summary, while the use of nested containers has been established in industry, challenges remain as to how to manage such containers within a controlled environment while ensuring that the equipment used in the process is cleanable to a degree acceptable in the pharmaceutical industry, an industry in which regulations are exceptionally stringent.

SUMMARY

In a first aspect this disclosure provides method for aseptically filling a first plurality of containers with a pharmaceutical product in a first controlled environment enclosure, the method comprising: decontaminating at least one of first and second sealed nested materials in a first transfer chamber; placing the first controlled environment enclosure in spatial communication with the first transfer chamber; aseptically gripping the at least one of first and second sealed nested materials; transferring the at least one of first and second sealed nested materials to the controlled environment enclosure; removing from one of the first and second sealed nested materials a container nest holding the first plurality of containers and removing from the other of the first and second sealed nested materials a closure nest releasably retaining a plurality of closures; filling the first plurality of containers with the pharmaceutical product in the first controlled environment enclosure; and at least partially closing the first plurality of containers with the plurality of closures. The method may further comprise maintaining aseptic conditions in the first controlled environment chamber and weighing the first plurality of containers while it is in the container nest.

The first plurality of containers may be in the closure nest during the at least partially closing. The aseptically gripping may comprise manipulating a first articulated arm apparatus. The closing of the first plurality of containers may comprise manipulating an articulated arm apparatus to place the first plurality of containers in a stoppering apparatus. The filling may comprise manipulating a second articulated arm apparatus. The filling of the first plurality of containers may comprise filling simultaneously at least a portion of the first plurality of containers.

The filling of the first plurality of containers may comprises manipulating an articulated arm apparatus to move one of the container nest and a fill needle system dispensing the pharmaceutical product. The dispensing of the pharmaceutical product may comprise dispensing the pharmaceutical product simultaneously from a plurality of fill needles. The removing of the container nest holding the first plurality of containers may be by manipulating a second articulated arm apparatus.

The method may further comprise returning the filled containers to the transfer chamber and terminating the spatial communication between the transfer chamber and the first controlled environment chamber.

The at least partially closing the first plurality of containers may comprise partially inserting the plurality of in the first plurality of containers; lyophilizing the pharmaceutical product in the first plurality of containers; and at least partially sealing the first plurality of containers by exerting pressure on at least a portion of a plurality of caps associated with the plurality of stoppers. The lyophilizing the pharmaceutical product may comprises lyophilizing the pharmaceutical product in a stoppering apparatus having an interior that may be isolated from the interior of the first controlled environment enclosure.

The partially closing of the first plurality of containers may comprises simultaneously partially closing at least a portion of the first plurality of containers. In other embodiments, the partially closing the first plurality of containers may comprise partially closing all the containers in the container nest simultaneously.

The at least partially closing may comprise completely closing and the method may further comprise transferring the filled containers to a second controlled environment enclosure. In some embodiments the partially sealed first plurality of containers may also be transferred to a second controlled environment chamber.

In another aspect the disclosure provides a method for aseptically sealing a pharmaceutical product into a plurality of containers, the method comprising: introducing a first plurality of containers into a controlled environment enclosure; releasably suspending from a closure nest in the controlled environment a plurality of aseptic closures; filling at least a first portion of the first plurality of containers with the pharmaceutical product; and simultaneously sealing at least partially a second portion of the first plurality of containers with a portion of the plurality of aseptic closures while releasably retaining the aseptic closures in the closure nest. The method may further comprise lyophilizing the pharmaceutical product in the second portion of the first plurality of containers while releasably retaining the aseptic closures in the closure nest.

The releasably suspending and releasably retaining may comprise releasably engaging with a holding feature of each of the plurality of aseptic closures. The releasably engaging with the holding feature may comprise elastically engaging with the holding feature. The elastically engaging with the holding feature may comprises engaging the holding feature with a spring-loaded retaining structure portion of the closure nest.

Some or all of the plurality of the aseptic closures retained by the closure nest may be used to either fully or partially seal the pharmaceutical product into the containers. The plurality of containers may be equal in number to the number of aseptic closures releasably suspended by the closure nest. Two or more containers may be filled simultaneously.

In another aspect this disclosure provides a closure nest for releasably retaining a plurality of closures for pharmaceutical containers, the closure nest comprising a plurality of closure retaining structures each comprising at least one spring-loaded retaining structure arranged to engage with a holding feature on one of the plurality of closures. The closure retaining structures may each further comprise a stop structure configured to exert force on and confine the one of the plurality of closures.

The at least one spring-loaded retaining structure may be monolithically integrated with the closure nest and the closure nest may be a polymeric closure nest. The at least one spring-loaded retaining structure may be a flexible retaining structure and, in some embodiments, the flexible retaining structure may be a polymeric structure. The plurality of closure retaining structures may be arranged in a geometric pattern and, in some embodiments, the geometric pattern may be a close packed pattern. The geometric pattern may match center-to-center a pattern of container-holding structures on a container nest.

BRIEF DESCRIPTION OF THE DRAWINGS

The drawings illustrate generally, by way of example, but not by way of limitation, various embodiments discussed in the present document.

DETAILED DESCRIPTION

Figure 1:
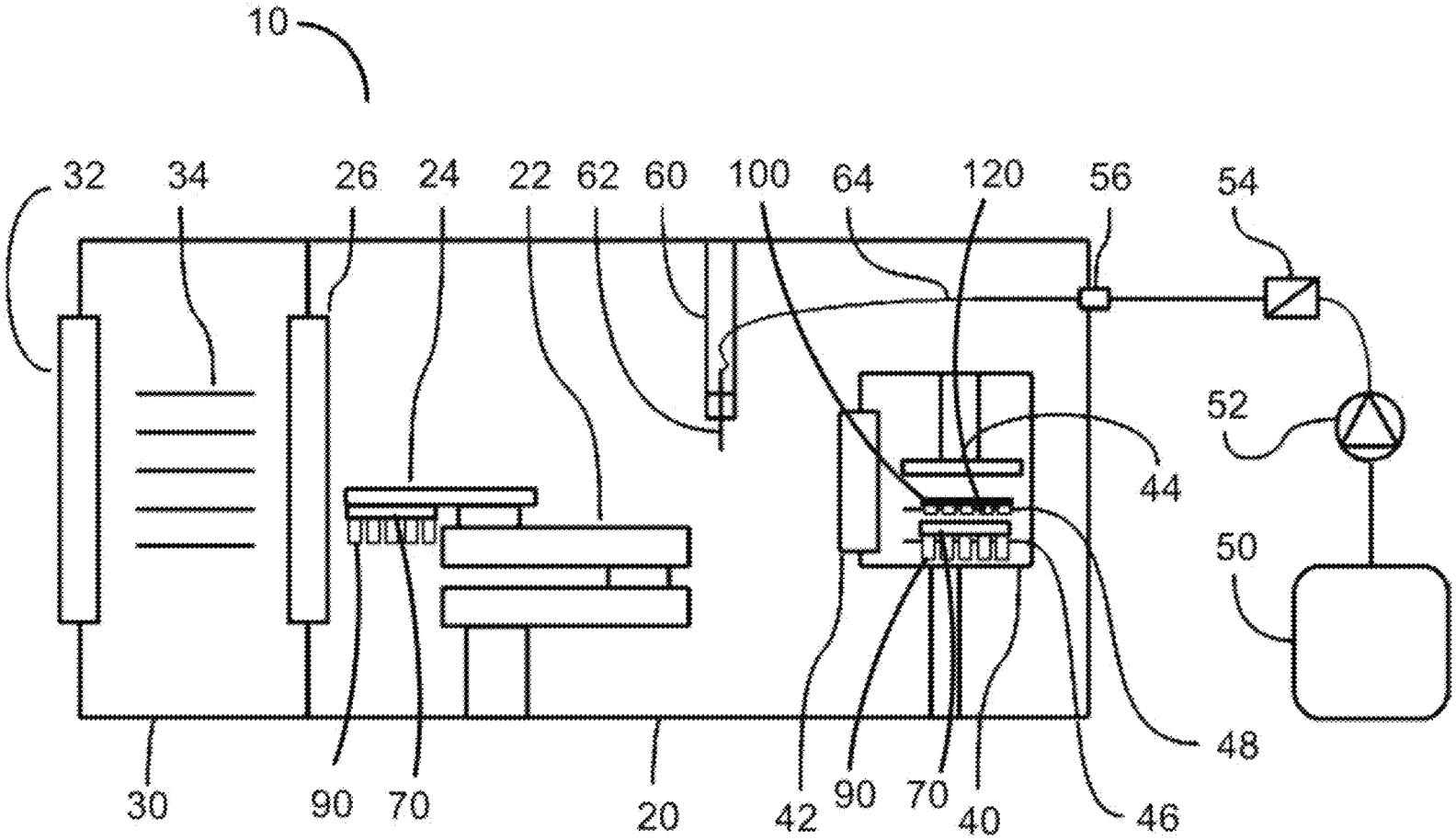
FIG. 1 shows a system for filling pharmaceutical containers.
Figure 2:
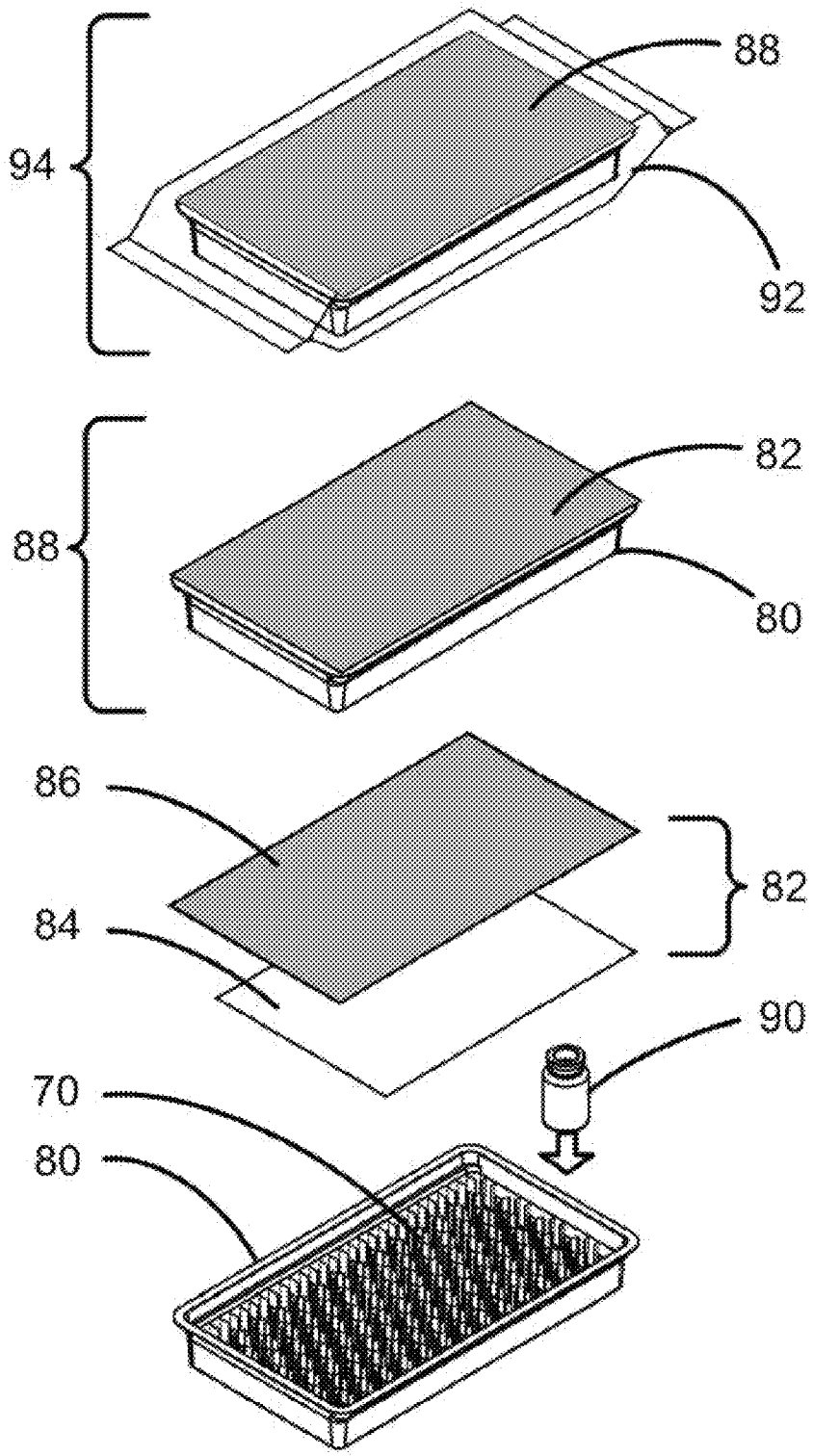
FIG. 2 shows from bottom to top the arrangement and contents of a sealed nested container package as employed in the present invention.
Figure 3:
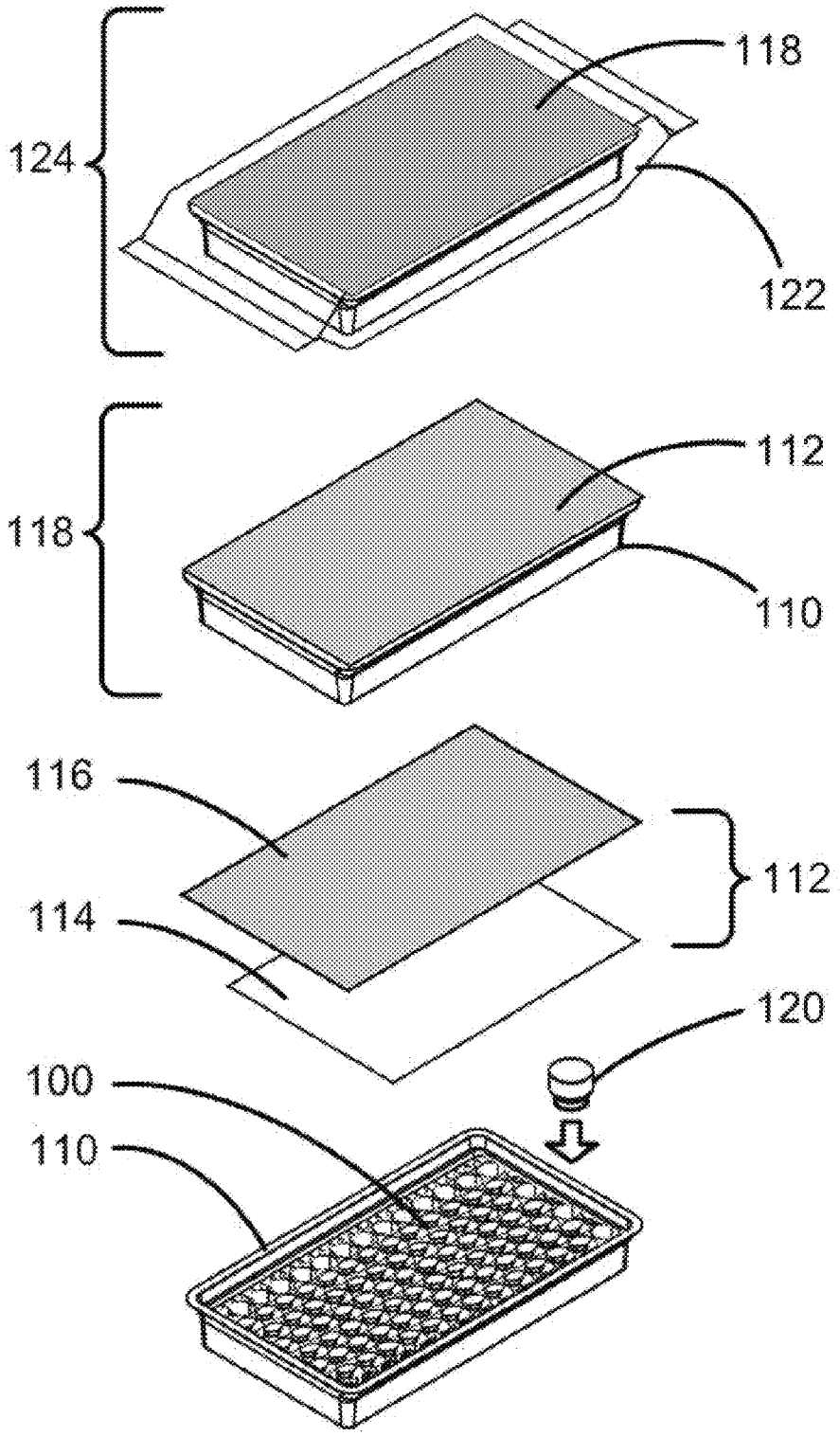
FIG. 3 shows from bottom to top the arrangement and contents of a sealed nested closure package as employed in the present invention.

A method and associated system for filling pharmaceutical containers is described at the hand of the schematic depiction in FIG. 1, as well as FIG. 2 and FIG. 3. A filling system 10 for filling pharmaceutical containers 90 with a pharmaceutical product is disposed within a controlled environment enclosure 20. Controlled environment enclosure 20 is configured for maintaining an aseptic condition. In some embodiments, in particular that shown in FIG. 1, the pharmaceutical product may be a liquid product. In other embodiments, the product may be a solid pharmaceutical product. The pharmaceutical product may potentially be toxic or otherwise harmful. As will be described in more detail below, the filling system 10 can be configured to locate, target, and fill containers 90 held in a container nest 70 within a container tub 80 (see FIG. 2). Many types of containers 90 are contemplated herein, including, but not limited to vials, syringes, bottles, and ampoules.

Pharmaceutical containers made from tubular glass are commercially available in a range of different sizes with dimensions according to the DIN/ISO 8362-1 standard. Molded glass vials are commercially available in a range of different sizes with dimensions according to the DIN/ISO 8362-4 standard. Frequently vials are used that have one or more additional custom specifications. In some cases these specifications may deviate from the standards.

Glass has traditionally been the only choice for container material but problems with glass breakage, delamination, particulates due to glass-on-glass collisions, and stability of some products resulted in development and usage of suitable polymeric materials. One example of such polymeric material is TOPAS® cyclic olefin polymer. Vials made of polymeric materials are commercially available in size ranges and dimensions that typically closely mimic those of glass vials.

Polymeric materials are significantly less scratch resistant than glass and existing aseptic processing equipment has not been redesigned to mitigate the risks of scratching. Scratched surfaces of containers are a serious concern for the perceived quality of the product, but also severely limits the inspection of the containers for particulates. Such inspection is typically a regulated requirement for good manufacturing practice.

Processing of vials in nests can be an effective solution to prevent scratching of vials such as typically occurs during singulated handling of vials or during simultaneous handling of rows of vials. Handling of vials in nests avoids all vial-tooling and vial-vial collisions. The nests are particularly well suited for processing of polymeric vials but may be used equally well for processing of glass vials.

Nests for syringes have been commercially available for some decades, but they are a comparatively new concept for the management of pharmaceutical containers beyond syringes. Suitable container nests 70 are available from Nuova Ompi of Newtown, Pa. and from Afton Scientific of Charlottesville, Va.

The containers 90, tub 80, and container nest 70 are shown in more detail in FIG. 2 in which the packaging of the containers 90 is depicted in stages of completeness from bottom to top. The container nest 70 and container tray or tub 80 may be, for example without limitation, of the polystyrene EZ-FILL™ type provided by Nuovo Ompi of Newtown, Pa. These are supplied with a sealing Tyvek™ cover 82 permeable to ethylene oxide for purposes of sterilization. The cover 82 may comprise of a permeable Tyvek™ sheet 84 and a Tyvek™ lid 86 over the permeable Tyvek™ sheet 84. In the present specification we refer to the combination of tub 80, sealed with cover 82 and containing the nest 70 with containers 90 as "sealed nested container materials" 88. Sealed nested container materials 88 may be supplied packaged in a steri-bag 92. In the present specification we refer to this entire combination, as shown in FIG. 2, as a "sealed nested container package" 94.

The closures 120 for the containers 90 may be supplied in similar fashion to the containers 90, as shown in FIG. 3. The closures may comprise caps 130 with integrated stoppers 140 and are described in more detail below at the hand of FIG. 6 and FIG. 7. The closures 120 are supplied arrayed within a closure nest 100 in a closure tub 110 with a sealing Tyvek™ cover 112 permeable to ethylene oxide for purposes of sterilization. The cover 112 may comprise of a Tyvek™ sheet 114 and a Tyvek™ lid 116 over the permeable Tyvek™ sheet 114. In the present specification we refer to the combination of tub 110, sealed with cover 112 and containing the closure nest 100 with closures 120 as "sealed nested closure materials" 118. Sealed nested container materials 118 may be supplied packaged in a steri-bag 122. In the present specification we refer to this entire combination, as shown in FIG. 3, as a "sealed nested closure package" 124. In the present specification sealed nested container materials 88 and sealed nested closure materials 118 are collectively referred to as "sealed nested materials."

Tubs 80, 110 may be handled within controlled environment enclosure 20 by an articulated arm apparatus 22 disposed within controlled environment enclosure 20. Articulated arm apparatus 22 comprises an end of arm tool 24 configured to hold tubs and nests. Articulated arm apparatus 22 may be, without limitation, a robotic articulated arm. Suitable robotic articulated arms are described in US Patent Application Publication US 2009/0223592A1 and in PCT Application Publication Number WO 2013/016248A1, both wholly incorporated herein by reference.

In contrast to prior art conveyor belt systems, the sealed nested closure packages 92, 122, the tubs 80, 110 and nests 70, 100 are gripped and held by end of arm tool 24, which can be capable of gripping or holding. Furthermore, as described in co-pending patent application US2009/0223592A1, titled "Robotic filling systems and methods" the articulated arm apparatus 22 allows environment enclosure 20 to be cleanable to a much greater degree than a conveyor belt system. Articulated arm apparatus 22 lends itself to being fully automated and this allows a greater degree of automation of the entire container-filling process within the controlled environment enclosure 20 than what is otherwise attainable under such decontaminated or sterilized conditions as pertain within controlled environment enclosure 20. The use of articulated arm apparatus 22 eliminates some of the difficulties described in the background to this specification. In particular, the articulated arm apparatus 22 allows the relevant nest to be held in a single action until processing is completed and the container or closure 90, 120 itself is not held, as all handling operations may be carried out by means of nests 70, 100 or tubs 80, 110.

As regards method, the sealed nested container- or closure package 94, 124 may be opened outside filling system 10. The cover 82, 112 may be highly permeable to the atmosphere and therefore the step of removing sealed tub 80, 110 from its packaging 88, 118 may expose not only the sealed tub 80, 110 but also its contents to ambient atmosphere.

With the inner door 26 between transfer chamber 30 and controlled environment enclosure 20 closed, the outer door 32 of transfer chamber 30 may be opened. Sealed tub 80, 110 containing the nest 70, 100 with containers or closures 90, 120 may then be transferred via outer door 32 of transfer chamber 30 onto shelves 34 of transfer chamber 30. Shelves 34 may be, without limitation, carousel shelves.

In a next step, sealed tub 80, 110 may be decontaminated inside transfer chamber 30. Suitable decontamination includes, but is not limited to exposure to hydrogen peroxide gas or ozone. Other suitable means of decontamination may include, without limitation, electron beam irradiation and ultraviolet irradiation. Transfer chamber 30 may be any isolatable and decontaminatable vessel, including without limitation, an autoclave or a radiation based decontaminatable vessel that is configured to be placed in spatial communication with controlled environment enclosure 20. In the present specification, the term "transfer chamber" is used to describe any such vessel that is decontaminatable and which may be placed in spatial communication with controlled environment enclosure 20. Further examples of vessels suitable for use as transfer chamber 30 are provided below.

In some cases it can be advantageous to decontaminate transfer chamber 30 together with controlled environment enclosure 20. When decontaminated simultaneously, the seals on inner door 26 will be decontaminated. In some other cases the seal area of door 26 may be negligible.

The covers 82, 112 may be highly permeable to gases and decontamination agents. Certain materials can be susceptible to significant sorption of decontamination agents during decontamination of the transfer chamber. Exposure of pre-sterilized materials of tub 80, 110 to decontamination agents can be prevented by use of an impermeable cover instead of cover 82, 112, or by addition of an impermeable layer on top of the cover 82, 112. Suitable methods for adding such an impermeable layer includes, without limitation adhesive film and heat seals.

In another aspect of this invention, the transfer chamber 30 may be a vacuum chamber; and is configured to sterilize the contents of the tub 80, 110. Thermal and fast non-thermal sterilization cycles are well known in the art. The fast cycle time of non-thermal sterilization cycles may be particularly advantageous. Such cycles are typically used in hospital settings, for example for sterilization of surgical instruments. Gaseous sterilization agents can be hydrogen peroxide, ozone and combinations thereof.

The transfer chamber 30 may be equipped with a plasma generator for rapid activation and removal of sterilization agents. The addition of non-thermal sterilizing transfer chamber 30 to controlled environment enclosure 20 is particularly well suited for processing of nested pharmaceutical container materials.

When tub 80, 110 has been decontaminated, inner door 26 may be opened to place the interior of transfer chamber 30 in communication with the interior of controlled environment enclosure 20 and articulated arm apparatus 22 may be employed to remove the sealed nested materials 88, 118 from transfer chamber 30 into controlled environment enclosure 20 through inner door 26. Since the articulated arm apparatus 22 is a decontaminated or sterilized structure, and it is gripping the tub 80, 110 in a decontaminated environment, the gripping of the tub 80, 110 by the articulated arm apparatus 22 is referred to in the present specification as "aseptically gripping." By way of contrast, other methods of transfer may not involve gripping or may not be aseptic, requiring the controlled environment enclosure 20 to be sterilized or decontaminated after transfer.

Articulated arm apparatus 22 may be employed to remove one or both of lid 86, 116 and sheet 84, 114 within controlled environment enclosure 20. A suitable method for using articulated arm apparatus 22 to remove lid 86/116 is described in co-pending Patent Application PCT/US13/39455, which is hereby incorporated in full. Sheet 84, 114 may alternatively be removed using suitable suction. Articulated arm apparatus 22 may then remove the nests 70, 100 with containers or closures 90, 120 from the tubs 80, 110.

Controlled environment enclosure 20 comprises a filling station 60. In one embodiment, shown in FIG. 1, the filling station 60 comprises fill needle system 62 supplied with liquid product via fluid path 64 from fluid reservoir 50 under the action of a suitable pump 52. Pump 52 may be, without limitation, a peristaltic pump. The liquid product may be filtered via a suitable filter 54. The fluid may enter into controlled environment enclosure 20 along fluid path 64 via a suitable fluid path connector 56.

In one embodiment of the method, shown in FIG. 1, articulated arm apparatus 22 may move an opening of each container 90 one after the other under fill needle system 62. Fill needle system 62 may comprise a single fill needle, or may comprise a plurality of fill needles. If fill needle system 62 comprises a single fill needle, the containers 90 are filled one after the other by moving the container nest 70 and operating the fill needle system 62 to fill the containers 90. If fill needle system 62 comprises a plurality fill needles, the containers 90 are filled one plurality after another by moving the container nest 70 and operating the fill needle system to fill the containers 90. The end of arm tool 24 can be rotated to align containers 90 with the fill needle(s) of fill needle system 62.

Figure 4:
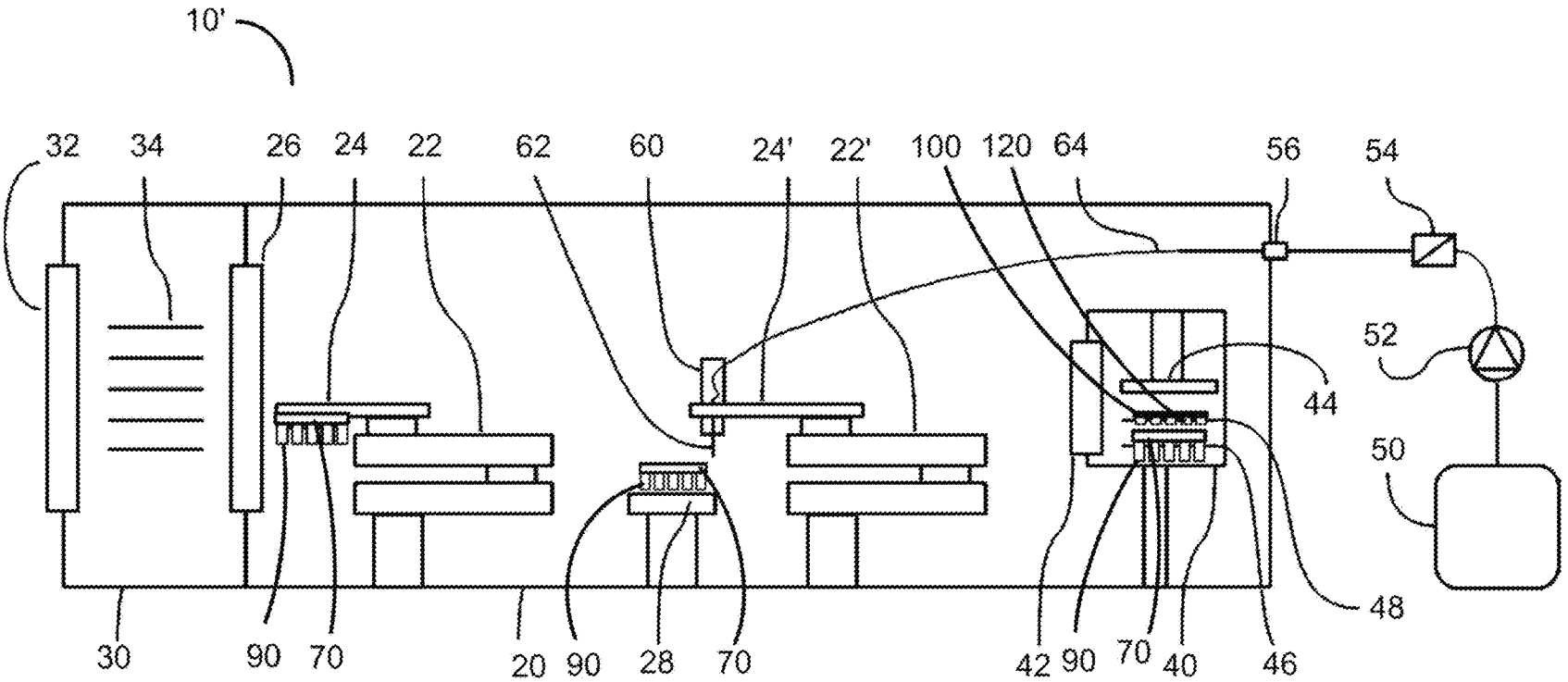
FIG. 4 shows an alternative embodiment of a system for filling pharmaceutical containers.

In another embodiment, shown in FIG. 4, the container nest 70 with containers 90 is placed in a fixed position on a pedestal 28 and the fill needle system 62 is spatially manipulated by a suitable second articulated arm apparatus 22' to place the fill needle system 62 above the openings of the containers 90. The containers 90 are thus filled by moving and operating the fill needle system. The second articulated arm apparatus may be of the same type as articulated arm apparatus 22. It may have an end of arm tool 24' configured for manipulating the fill needle system 62. Having a second articulated arm apparatus dedicated to filling, frees up the articulated arm apparatus 22 for handling of a second tub 80, 110 and nest 70, 100 while a first tub 80, 110 is being filled.

Filling system 10 comprises a stoppering apparatus 40 that may have an interior that may be isolated from the interior of controlled environment enclosure 20. The interior of controlled environment enclosure 20 is in communication with an interior of stoppering apparatus 40 via stoppering system door 42. In the embodiment depicted in FIG. 1, stoppering apparatus 40 is shown as being contained within controlled environment enclosure 20. In other embodiments stoppering apparatus 40 may be arranged in a separate chamber from controlled environment enclosure 20 and may communicate with controlled environment enclosure 20 via a suitable stoppering system door.

A container nest shelf 46 and a closure nest shelf 48 are disposed within the interior of stoppering apparatus 40. Container nest shelf 46 and a closure nest shelf 48 are disposed to allow closures 120 in closure nest 100 to be centered on the openings of containers 90 in container nest 70 when closure nest 100 and container nest 70 are placed on respectively container nest shelf 46 and closure nest shelf 48.

In one embodiment of the method, shown in FIG. 1, stoppering system door 42 is opened and articulated arm apparatus 22 moves container nest 70 with filled containers 90 to place it on container nest shelf 46. Articulated arm apparatus 22 may be used to move closure nest 100 with closures 120 to place it on closure nest shelf 48. Each filled container 90 thereby has a closure concentrically positioned directly above it. Closure nest 100 with closures 120 may be placed on closure nest shelf 48 either before or after container nest 70 with filled containers 90 is placed on container nest shelf 46. To this end the container nest 70 and closure nest 100 may have mutually matching geometries to arrange a closure 120 concentrically with the opening of a container 90.

After the container nest 70 with containers 90 and closure nest 100 with closures 120 have been located on their respective shelves 46 and 48 within stoppering apparatus 40, stoppering system door 42 is closed. To the extent that some stoppering procedures need to be performed under vacuum conditions or under inert atmosphere, the required vacuum or inert atmosphere may then be established within the interior of stoppering apparatus 40.

Stoppering apparatus 40 is configured close all containers simultaneously using an actuated ram 44. For some subsequent operations, such as freeze-drying, the stoppers are required to be only partially inserted and actuated ram 44 may be configured to only partially insert the stoppers 140. After insertion of the stoppers 140, the articulated arm apparatus 22 removes nest 70 with containers 90 from stoppering apparatus 40.

In another embodiment of the articulated arm apparatus 22 loads nested containers 90 and nested caps 130 with integrated stoppers 140 into stoppering apparatus 40. As described above, apparatus 40 can simultaneously stopper and cap a nest 70 of containers 90.

After completion of the stoppering and capping, the articulated arm apparatus 22 moves the nested containers 90 back into transfer chamber 30. In other embodiments, the articulated arm apparatus 22 may move the filled, stoppered, and capped nest 70 with containers 90 to an adjacent controlled environment enclosure (not shown) through a suitable communicating door (not shown). The capped nest 70 with containers 90 may be moved to the adjacent controlled environment enclosure with the containers only partially stoppered or partially closed.

Figure 5A:
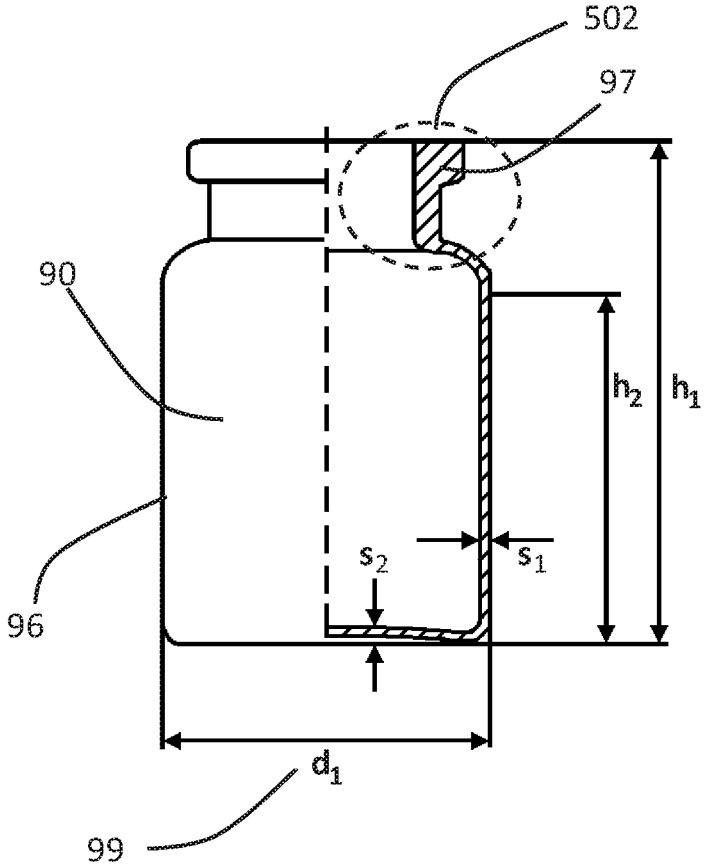
FIGS. 5A and 5B show two views of a pharmaceutical container and its key dimensions, FIG. 5B showing an enlarged view of the pharmaceutical container of FIG. 5B.
Figure 5B:
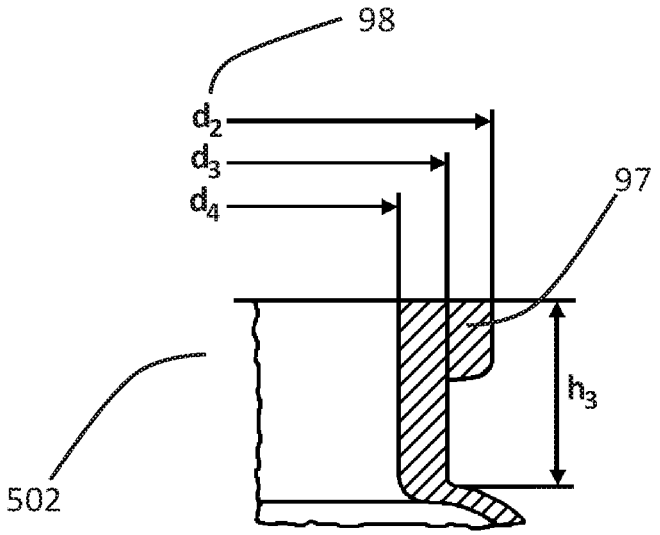

FIGS. 5A and 5B show the generic shape of a pharmaceutical container 90, which in this example is a vial. The container comprises a cylindrical container body 96 and a neck 97. The neck 97 of container 90 is shown in enlarged view on the right. Typically, the $d_2$ neck diameter 98 of the container 90 is only slightly smaller than the $d_1$ main diameter 99 of container 90. This allows the placement of a cap 130 on the vial without reducing the packing density of containers 90 in nest 70 of FIG. 2. Therefore, the densest circle packing density of the caps is closely the same as the packaging of the containers. It is particularly advantageous for the cap nest to have exactly same packaging geometry as the vial nest; so that cap nest can be overlaid on the vial nest and caps be applied without movement of the nest. Caps can be applied one at the time, multiples in a row, or all at once.

Figure 6A:
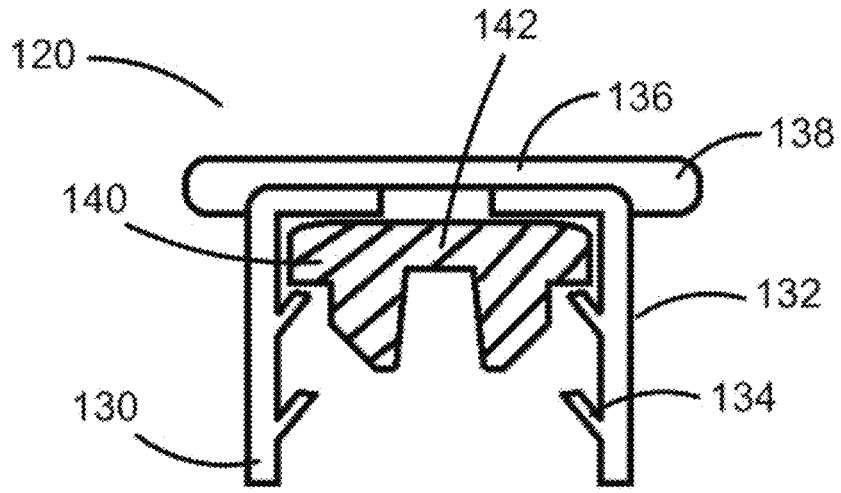
FIG. 6A and FIG. 6B show two embodiments of closures for pharmaceutical containers

In another aspect, this specification provides a nest for holding closures. We consider first the generic closure 120 provided in FIG. 6A. Closure 120 comprises cap 130 and stopper 140. Stopper 140 has a thinner septum 142 that is pierceable by an extraction needle such as that of a syringe. Cap 130 comprises a cylindrical cap body 132, at least a first set of barbed retention features 134, and a tamper-evident flip-off cover 136. In the example of FIG. 6A two sets of barbed retention features 134 are shown and these may be arranged in a pattern around the inner perimeter of the cap 130. The tamper-evident flip-off cover 136 is manufactured as an integral part of cap 130 such that, when cover 136 is removed, it cannot be replaced. This serves as verification that septum 142 of stopper 140 has been exposed. Cover 136, in this particular example, has a larger diameter than body 132 of the cap 130. This may serve as a holding feature 138 for cap 130 and thereby for closure 120, which may be exploited for holding closure 120 in nest 100.

Figure 6B:
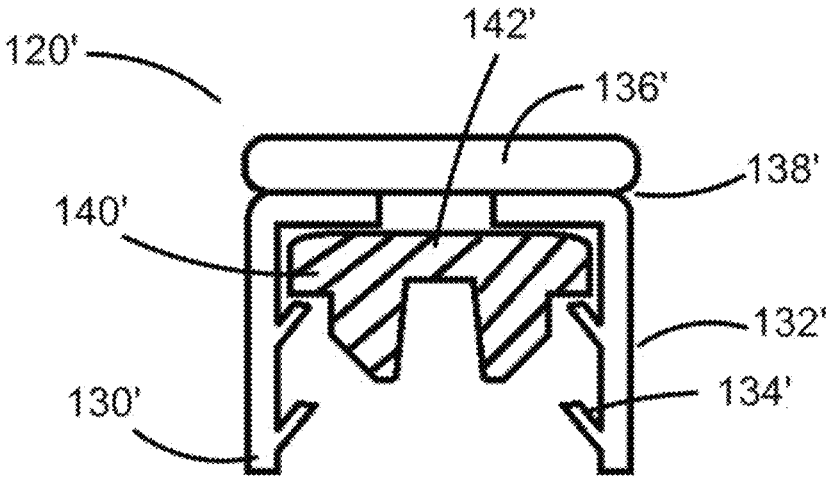

In FIG. 6B another example closure 120'. Closure 120' comprises cap 130' and stopper 140'. Stopper 140' has a thinner septum 142' that is pierceable by an extraction needle such as that of a syringe. Cap 130' comprises a cylindrical cap body 132', at least a first set of barbed retention features 134', and a tamper-evident flip-off cover 136'. In the example of FIG. 6A two sets of barbed retention features 134' are shown and these may be arranged in a pattern around the inner perimeter of the cap 130'. The tamper-evident flip-off cover 136' is manufactured as an integral part of cap 130' such that, when cover 136' is removed, it cannot be replaced. This serves as verification that septum 142' of stopper 140' has been exposed. Cover 136', in this particular example, has the same diameter as body 132' of the cap 130'. However, a dimple 138' is provided at the join between the cover 136' and the cap body 132'. This may serve as a holding feature 138' for cap 130' and thereby for closure 120', which may be exploited for holding closure 120' in nest 100.

In the prior art these vial caps have been made from aluminum with polymeric flip-off covers. Capping of aluminum caps typically generates considerable amounts of non-viable particles and this has tended to make aluminum caps unacceptable in recent times. Caps made of polymeric material are now commercially available. The polymeric caps are particularly well suited for use with polymeric containers, but can also be used for glass containers.

The most optimal geometry of containers 90 in a nest 70 follows the mathematical theories of equal sized circle packing, leading typically to hexagonal, triangular, square, elongated triangular; snub square and other related geometrical patterns of container positions in nest 70.

In this specification, a closure nest 100 is presented in which the geometrical arrangement of the closures 120, 120' closely matches the geometrical patterns of container positions in nest 70. In some embodiments, closure nest 100 has exactly same packaging geometry as the container nest 70, with the distribution of closure centers in closure nest 100 lining up within a working tolerance with the distribution of container centers in container nest 70. This allows closure nest 100 to be overlaid on container nest 70, and closures 120, 120' to be applied to containers 90 so that all the closures 120, 120' in closure nest 100 may be applied to all the containers 90 in container nest 70 without any substantial movement of either nest 70 or nest 100. Closures 120, 120' may be applied one at a time, one row at a time, or all at substantially the same time.

Figure 7A:
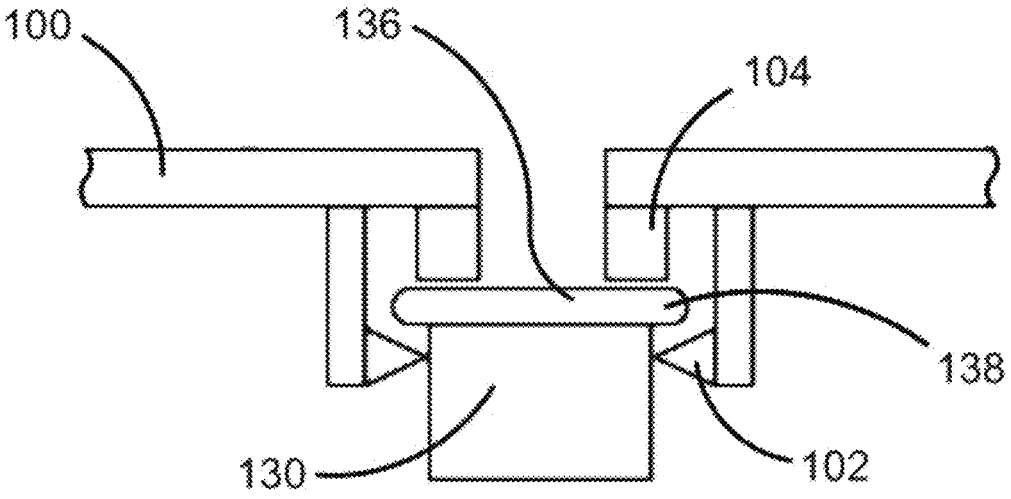
FIG. 7A and FIG. 7B show two embodiments of closure retaining structures for closure nests.

In FIG. 7A a part of closure nest 100 is shown schematically, depicting a closure retaining structure for a single cap 130 of closure 120 of FIG. 6A. In FIG. 7A the associated stopper 140 is contained within cap 130 and is therefore not visible. It is to be understood that the part of closure nest 100 shown in FIG. 7A is descriptive of a plurality of such parts, and that the parts are arranged two dimensionally to concentrically align a plurality of containers 90 in container nest 70 center-to-center with a plurality of closures 120 held by closure nest 100. The closure retaining structure comprises a spring-loaded retaining structure 102, arranged to engage with holding feature 138 on cover 136 of cap 130, thereby holding cap 130 vertically suspended. The closure retaining structure further comprises a stop structure 104 against which cap 130 can push when cap 130 and closure nest 100 are pushed together vertically. The cap 130' of FIG. 6B may similarly be held by its specific holding feature 138'.

Figure 7B:
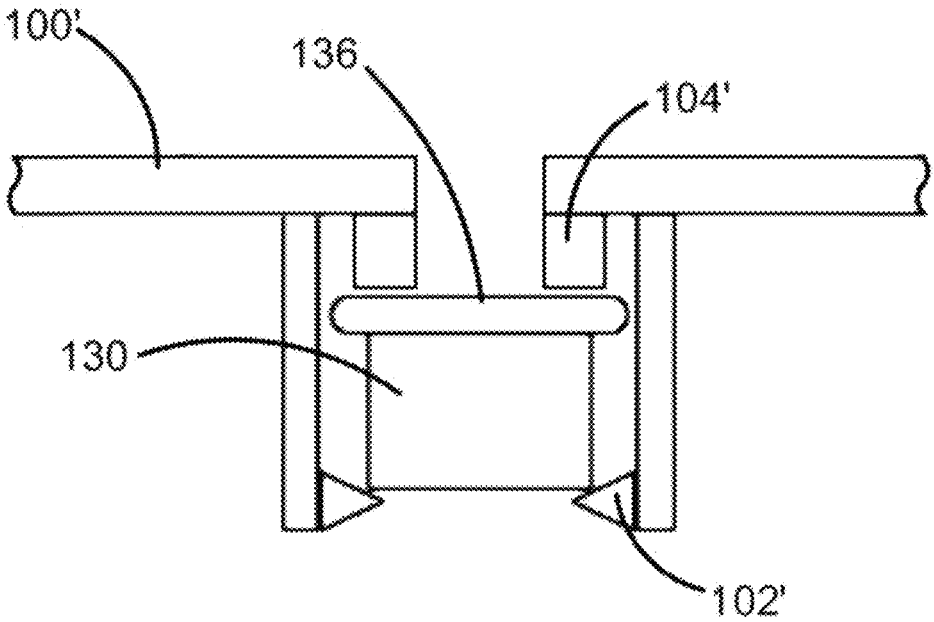

In FIG. 7B a part of another closure nest 100' is shown schematically, depicting a closure retaining structure for a single cap 130 of closure 120 of FIG. 6A. In FIG. 7B the associated stopper 140 is contained within cap 130 and is therefore not visible. It is to be understood that the part of closure nest 100' shown in FIG. 7B is descriptive of a plurality of such parts, and that the parts are arranged two dimensionally to concentrically align a plurality of containers 90 in container nest 70 center-to-center with a plurality of closures 120 held by closure nest 100'. The closure retaining structure comprises a spring-loaded retaining structure 102', arranged to engage with the bottom of cap 130, thereby holding cap 130 vertically suspended. In this arrangement, the bottom of cap 130 therefore serves as generic holding feature. The closure retaining structure further comprises a stop structure 104' against which cap 130 can push when cap 130 and closure nest 100' are pushed together vertically.

The spring-loaded retaining structure may be implemented in different ways. One non-limiting example spring-loaded retaining structure 102 is an elastically flexible retaining structure. Spring-loaded retaining structure 102 may be a separate structure from closure nest 100 that is fastened to closure nest 100. In other embodiments, spring-loaded retaining structure 102 is an integral part of closure nest 100 and may be manufactured to be monolithically integrated with closure nest 100. One non-limiting way of manufacturing spring-loaded retaining structure 102 as a monolithically integrated part of closure nest 100, is by injection molding of a suitable polymer.

Spring-loaded retaining structure 102 holds cap 130, 130' in place during handling and transport; and can flex open without risk of removing the tamper evident cover 136, 136' when the cap 130, 130' is being pushed or pulled out of the closure nest 100, 100'. The direction of capping force can be upwards, downwards or both. Sections of the closure nest 100, 100' can be reinforced by structural features such as honeycombs to distribute the capping force and to prevent bowing during handling.

The integrity of the container 90 and closure 120, 120' is achieved by deforming the elastomeric stopper 140, 140' by compressing the elastomeric stopper 140, 140' against the container 90 and permanently holding it in this compressed state by the cap 130, 130'. The radial compression of stopper 140, 140' by the interference fit inside of the neck of container 90, as indicated with diameter d4 in FIG. 5 may well create a seal, but that seal is generally considered no more than a secondary seal. In fact some stopper designs for cap 130, 130' may go without any plug shape surrounding septum 142, 142'.

It is the vertical compression of the flange part of stopper 140, 140' against the top of the container 90, on the area of container 90 indicated with diameters d4 and d2 in FIG. 5, that creates the primary seal. Typically, a high residual sealing force is required to guarantee a robust container seal and provides a wide safety margin for changes in stopper 130, 130', such as compression set. The compression force required for final sealing has to be conveyed through the top surface of cap 130, 130'. Therefore, an annular shape may be one non-limiting employed for stop structure 104, 104' to apply the compression force to the area of cap 130, 130' directly above the primary seal. Moreover, an annular shape for stop structure 104, 104' allows for removal of the capped vial from nest by insertion of a push rod through the opening.

Different shapes may be employed for stop structures 104, 104', depending on the particular design of the cap. The stop structures 104, 104' also determine the length of the spring-loaded retaining structure 102, 102' and therefore its spring retention and opening force. The spring-loaded retaining structure 102, 102' may be substantially linear and orthogonal to the closure nest 100, 100'. In yet other examples the height of stop structures 104, 104' and spring-loaded retaining structure 102, 102' can be reduced by curling radially. In those cases where steam sterilization is required of the caps 130, 130' in the closure nest 100, 100', the contact area between stop structure 104, 104' and cap 130, 130' can be reduced to a series of point contacts to allow for good accessibility of steam.

The spring-loaded retaining structure 102, 102' may be sized and shaped such that, when cap 130, 130' is secured on the container 90, spring-loaded retaining structure 102, 102' is automatically pushed out of the way by container 90, thereby releasing the cap 130, 130'. The close packing of closure retaining structures on closure nest 100, 100' implies that there is limited space for lateral motion of spring-loaded retaining structures 102, 102'. For example, in a hexagonal close packed arrangement, each closure retaining structure is surrounded by six nearest neighbor closure retaining structures, each requiring space for its spring-loaded retaining structures 102, 102' to open in order to release a corresponding cap 130. Each spring-loaded retaining structure 102, 102' is sized and positioned to allow caps 130, 130' on neighboring closure retaining structures to be applied simultaneously to containers 90 correspondingly arranged in container nests 70.

In one embodiment, caps 130, 130' are each held by at least three spring-loaded retaining structures 102, 102' in order to geometrically restrain the cap in its position. In general each closure retaining structure on closure nest 100, 100' implies has a plurality of spring-loaded retaining structures 102, 102'. In concept, there can be a single annular spring-loaded retaining structure 102, 102' for each single closure retaining structure, arranged to grip around the entire perimeter of the cap 130, 130'. The most general embodiment of closure nest 100, 100' therefore has at least one spring-loaded retaining structure 102, 102' for each closure retaining structure.

In operation, a plurality of closures 120, 120' is releasably retained in a closure nest 100, 100' through being held by spring-loaded retaining structures 102, 102' being engaged with holding features 138 of closures 120, 120', the closure bottoms being a special kind of holding feature. To engage the closures 120, 120' in this fashion, the closures 120, 120' are pushed into the closure retaining structures, during which action the spring-loaded retaining structures 102, 102' are elastically displaced by the caps 130, 130' of the closures 120, 120' until spring-loaded retaining structures 102, 102' click into position on the holding features 138, 138'. The closures are then supplied to the filling process in this configuration.

Figure 8:
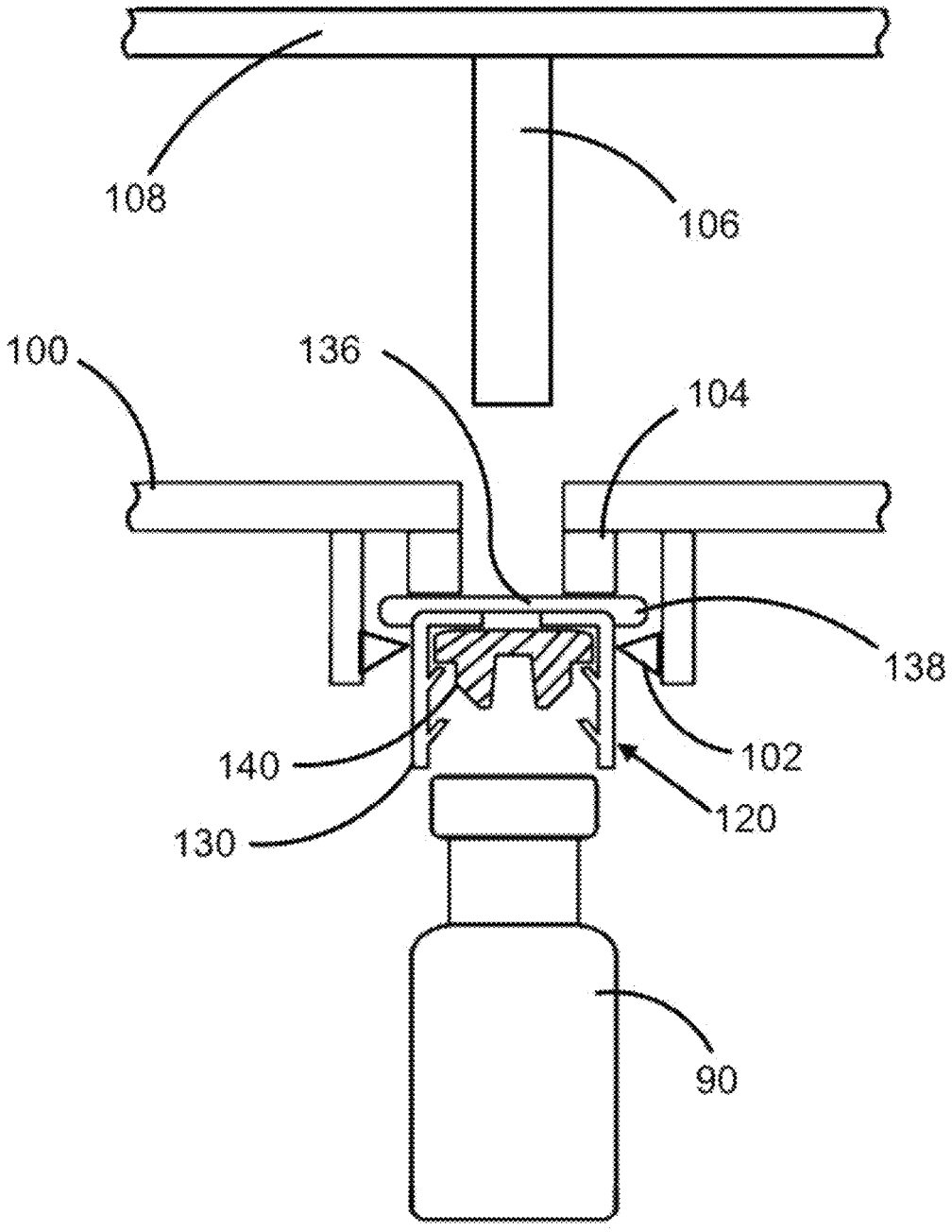
FIG. 8 shows an arrangement for closing the container of FIG. 5 with the closure of FIG. 6A using the closure retaining structures of FIG. 7A.

FIG. 8 shows the configuration for the closing of a single container 90, being one of a plurality of containers held in container nest 70 of FIGS. 1, 2 and 4. For closing, the closure 120, being one of a corresponding plurality of closures 120 releasably retained by closure nest 100, is concentrically aligned with container 90 by virtue of the geometries of nests 70 and 100 corresponding center-to-center with each other in two dimensions. The closure holding structure is that of FIG. 7A and the closure detail is that of FIG. 6A, with a limited number of elements of the closure 120 labeled for clarity. When elements are not numbered, the numbers of FIG. 6A pertain.

During the closing of container 90 with closure 120, container 90 and closure 120 are vertically forced together. This may be done to a degree that merely causes the top of container 90 to engage with barbed retention features 134 (See FIG. 6A). This constitutes partial closing. The application of further force pushes stopper 140 via stop structures 104 deeper into container 90 to seal it. In a final step, container 90, duly capped and closed with closure 120, may be disengaged from the closure holding structure of closure nest 100 by pushing downward on the cover 136 of cap 130 of closure 120 with rod 106 attached to platen 108. The platen 106 may extend over the whole surface of closure nest 100 or may extend over part of it. There may be the same number of rods as the number of closures held by closure nest 100, or the rods 106 may be fewer. This action forces open the spring-loaded retaining structures 102, 102' and releases the capped container 90 from the closure holding structure of closure nest 100. This process or method may be conducted simultaneously for a plurality of closure holding structures of closure nest 100. All the closures in all the closure holding structures of closure nest 100 may undergo this procedure simultaneously.

In a most general description, this specification provides a closure nest 100, 100' for releasably retaining a plurality of closures 120, 120' for pharmaceutical containers, the closure nest 100, 100' comprising a plurality of closure retaining structures each comprising at least one spring-loaded retaining structure 102, 102' and a stop structure 104, 104', the spring-loaded retaining structure 102, 102' configured to engage with a holding feature 138 on one of the plurality of closures 120, 120' and the stop structure 104, 104' configured to exert force on and confine the one of the plurality of closures 120, 120'. The closure retaining structures may be arranged in a geometric pattern, which geometric pattern may be a close packed pattern and which may match center-to-center a corresponding a pattern of container-holding structures on a container nest. The spring-loaded retaining structure 102, 102' may be a flexible structure and may be manufactured from a polymer. The spring-loaded retaining structure 102, 102' may be monolithically integrated with the closure nest 100, 100'.

Associated with the closure nest 100, 100' a method for holding a plurality of closures 120, 120' comprises releasably retaining each closure 120, 120' by releasably suspending each closure 120, 120' by a holding feature 138 on closure 120, 120', the holding feature being a specifically designed holding feature 138 or the bottom of a closure as in FIG. 7B. The releasably suspending can be spring-loaded retaining, which is achieved by flexibly deforming or spring-wise deforming a spring-loaded retaining structure 102, 102'. The term "spring-loaded" is used in this specification to describe any form of spring loading, whether by mechanical spring or by a flexible member, or by any other means that will produce a suitable spring or elastic action.

The method provided here for aseptically sealing a pharmaceutical product into a plurality of containers comprises: introducing a first plurality of containers into a controlled environment enclosure; releasably suspending from a closure nest in the controlled environment a plurality of aseptic closures; filling at least a first portion of the first plurality of containers with the pharmaceutical product; and simultaneously sealing at least partially a second portion of the first plurality of containers with a portion of the plurality of aseptic closures while releasably retaining the aseptic closures in the closure nest. The method may further comprise lyophilizing the pharmaceutical product in the second portion of the first plurality of containers while releasably retaining the aseptic closures in the closure nest.

The releasably suspending and releasably retaining may comprise releasably engaging with a holding feature of each of the plurality of aseptic closures. The releasably engaging with the holding feature may comprise elastically engaging with the holding feature. The elastically engaging with the holding feature may comprises engaging the holding feature with a spring-loaded retaining structure portion of the closure nest.

Some or all of the plurality of the aseptic closures retained by the closure nest may be used to either fully or partially seal the pharmaceutical product into the containers. The plurality of containers may be equal in number to the number of aseptic closures releasably suspended by the closure nest. Two or more containers may be filled simultaneously.

As regards benefits, the closure nest 100, 100', with its spring-loaded retaining structures 102, 102' and stop structures 104, 104' described in this specification, lends itself to the simultaneous capping and stoppering, both partially and completely, of pluralities of containers 90. More specifically, it lends itself to the simultaneous capping, both partially and completely, of rows of containers 90. Yet more specifically, it lends itself to the simultaneous capping, both partially and completely, of complete two-dimensional arrays of containers 90 in container nests 70. There is no direct contact between the closure nest 100, 100' and any parts that will contact the pharmaceutical product. All handling of the closures 120, 120' by the articulated arm apparatus 22 is by means of the closure nest 100, 100'. All contact with the closure nest 100, 100' within the aseptic environment of controlled environment enclosure 20 is by means of devices and surfaces that may be sterilized.

The drawings and the associated descriptions are provided to illustrate embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment. As used in this disclosure, except where the context requires otherwise, the term "comprise" and variations of the term, such as "comprising", "comprises" and "comprised" are not intended to exclude other additives, components, integers or steps.

Also, it is noted that the embodiments are disclosed as a process that is depicted as a flowchart, a flow diagram, a structure diagram, or a block diagram. Although a flowchart may disclose various steps of the operations as a sequential process, many of the operations can be performed in parallel or concurrently. The steps shown are not intended to be limiting nor are they intended to indicate that each step depicted is essential to the method, but instead are exemplary steps only. In the foregoing specification, the invention has been described with reference to specific embodiments thereof. It will, however, be evident that various modifications and changes may be made thereto without departing from the broader spirit and scope of the invention. The specification and drawing are, accordingly, to be regarded in an illustrative rather than a restrictive sense. It should be appreciated that the present invention should not be construed as limited by such embodiments.

From the foregoing description it will be apparent that the present invention has a number of advantages, some of which have been described herein, and others of which are inherent in the embodiments of the invention described or claimed herein. Also, it will be understood that modifications can be made to the device, apparatus and method described herein without departing from the teachings of subject matter described herein. As such, the invention is not to be limited to the described embodiments except as required by the appended claims.

The invention claimed is:

1. A method for aseptically filling a first plurality of containers with a pharmaceutical product in a first controlled environment enclosure, the method comprising:

providing first and second sealed nested materials, wherein the first sealed nested material comprises a container nest retaining a first plurality of containers, and the second nested material comprises a closure nest releasably retaining a plurality of closures;

decontaminating at least the first sealed nested material in a first transfer chamber;

placing the first transfer chamber in spatial communication with the first controlled environment enclosure;

aseptically gripping at least the decontaminated first sealed nested material;

transferring at least the gripped first sealed nested material into the first controlled environment enclosure;

removing the container nest from the decontaminated first sealed nested material within the first controlled environment enclosure;

removing the closure nest from the second sealed nested material;

filling the first plurality of containers with the pharmaceutical product in the first controlled environment enclosure; and at least partially closing, in the first controlled environment enclosure, the filled first plurality of containers with the plurality of closures, wherein the container nest is vertically aligned and overlaid with the closure nest during the at least partially closing.

2. The method of claim 1, wherein the aseptically gripping comprises manipulating a first articulated arm apparatus.

3. The method of claim 2, wherein the filling comprises manipulating a second articulated arm apparatus.

4. The method of claim 1, wherein the filling the first plurality of containers comprises filling simultaneously at least a portion of the first plurality of containers.

5. The method of claim 1, wherein the filling the first plurality of containers with the pharmaceutical product comprises manipulating a first articulated arm apparatus to move at least one of the container nest and a fill needle system dispensing the pharmaceutical product.

6. The method of claim 5, wherein the filling of the first plurality of containers with the pharmaceutical product comprises dispensing the pharmaceutical product from a fill needle.

7. The method of claim 5, wherein the removing the container nest holding the first plurality of containers is by manipulating one of the first articulated arm apparatus and a second articulated arm apparatus.

8. The method of claim 5, wherein the filling of the first plurality of containers with the pharmaceutical product comprises dispensing the pharmaceutical product simultaneously from a plurality of fill needles.

9. The method of claim 1, wherein the at least partially closing the filled first plurality of containers comprises:

a. partially inserting the plurality of closures in the filled first plurality of containers so that each of the filled first plurality of containers is partially closed;

b. lyophilizing the pharmaceutical product in the first plurality of containers; and c. sealing the first plurality of containers by exerting pressure on at least a portion of a plurality of caps associated with the plurality of closures.

10. The method of claim 9, wherein the lyophilizing the pharmaceutical product comprises lyophilizing the pharmaceutical product in a stoppering apparatus having an interior that is one of isolated from the interior of the first controlled environment enclosure and in communication with the interior of the first controlled environment enclosure.

11. The method of claim 1, wherein the partially closing the filled first plurality of containers comprises simultaneously partially closing at least a portion of the filled first plurality of containers.

12. The method of claim 1, wherein the partially closing the filled first plurality of containers comprises partially closing all the filled first plurality of containers in the container nest simultaneously.

13. The method of claim 1, wherein the partially closing the filled first plurality of containers comprises manipulating an articulated arm apparatus to place the filled first plurality of containers in a stoppering apparatus.

14. The method of claim 1, further comprising returning the filled first plurality of containers to the first transfer chamber and terminating the spatial communication between the first transfer chamber and the first controlled environment enclosure.

15. The method of claim 1, wherein the at least partially closing comprises completely closing and the method further comprises transferring the filled first plurality of containers to a second controlled environment enclosure.

16. The method of claim 1, further comprising transferring the partially closed filled first plurality of containers to a second controlled environment enclosure.

17. The method of claim 1, further comprising maintaining aseptic conditions in the first controlled environment enclosure.

18. The method of claim 1, wherein the at least partially closing the filled first plurality of containers with the plurality of closures is at least partially closing the filled first plurality of containers while the first plurality of containers is in the closure nest.

19. The method of claim 1, wherein the decontaminating includes at least one of electron beam decontamination and ultraviolet radiation decontamination.

20. The method of claim 1, wherein the decontaminating includes at least one of steam and chemical exposure.

21. The method of claim 1, wherein the decontaminating the first sealed nested material comprises covering the first sealed nested material with an impermeable cover.

22. The method of claim 1, further comprising weighing the first plurality of containers while the first plurality of containers is in the container nest.

23. The method of claim 1, wherein the aseptically gripping step includes aseptically gripping a tub of the first sealed nested materials.

24. The method of claim 1, wherein the aseptically gripping step includes aseptically gripping a cover of the first sealed nested materials.

25. A method for aseptically filling a first plurality of containers with a pharmaceutical product in a first controlled environment enclosure, the method comprising:

providing first and second sealed nested materials, wherein the first sealed nested material comprises a container nest retaining a first plurality of containers, and the second nested material comprises a closure nest releasably retaining a plurality of closures;

decontaminating at least the second sealed nested material in a first transfer chamber;

placing the first transfer chamber in spatial communication with the first controlled environment enclosure;

aseptically gripping the decontaminated second sealed nested material;

transferring at least the gripped second sealed nested material into the first controlled environment enclosure;

removing the closure nest from the decontaminated second sealed nested material within the first controlled environment enclosure;

removing the container nest from the first sealed nested material;

filling the first plurality of containers with the pharmaceutical product in the first controlled environment enclosure; and at least partially closing, in the first controlled environment enclosure, the filled first plurality of containers with the plurality of closures, wherein the closure nest is vertically aligned and overlaid with the container nest during the at least partially closing.

26. The method of claim 25, wherein the aseptically gripping comprises manipulating a first articulated arm apparatus.

27. The method of claim 26, wherein the filling comprises manipulating a second articulated arm apparatus.

28. The method of claim 25, wherein the filling the first plurality of containers comprises filling simultaneously at least a portion of the first plurality of containers.

29. The method of claim 25, wherein the filling the first plurality of containers with the pharmaceutical product comprises manipulating a first articulated arm apparatus to move one of the container nest and a fill needle system dispensing the pharmaceutical product.

30. The method of claim 29, wherein the filling the first plurality of containers with the pharmaceutical product comprises dispensing the pharmaceutical product from a fill needle.

31. The method of claim 29, wherein the filling the first plurality of containers with the pharmaceutical product comprises dispensing the pharmaceutical product simultaneously from a plurality of fill needles.

32. The method of claim 29, wherein the removing the container nest holding the first plurality of containers is by manipulating one of the first articulated arm apparatus and a second articulated arm apparatus.

33. The method of claim 25, wherein the at least partially closing the first plurality of containers comprises:

a. partially inserting the plurality of closures in the first plurality of containers;

b. lyophilizing the pharmaceutical product in the first plurality of containers; and c. sealing the first plurality of containers by exerting pressure on at least a portion of a plurality of caps associated with the plurality of closures.

34. The method of claim 33, wherein the lyophilizing the pharmaceutical product comprises lyophilizing the pharmaceutical product in a stoppering apparatus having an interior that is one of isolated from the interior of the first controlled environment enclosure and in communication with the interior of the first controlled environment enclosure.

35. The method of claim 25, wherein the partially closing the first plurality of containers comprises simultaneously partially closing at least a portion of the first plurality of containers.

36. The method of claim 25, wherein the partially closing the first plurality of containers comprises partially closing all the containers in the container nest simultaneously.

37. The method of claim 25, wherein the closing the first plurality of containers comprises manipulating an articulated arm apparatus to place the first plurality of containers in a stoppering apparatus.

38. The method of claim 25, further comprising returning the filled containers to the first transfer chamber and terminating the spatial communication between the first transfer chamber and the first controlled environment enclosure.

39. The method of claim 25, wherein the at least partially closing comprises completely closing and the method further comprises transferring the filled containers to a second controlled environment enclosure.

40. The method of claim 25, further comprising transferring the partially closed first plurality of containers to a second controlled environment enclosure.

41. The method of claim 25, further comprising maintaining aseptic conditions in the first controlled environment enclosure.

42. The method of claim 25, wherein the at least partially closing the first plurality of containers with the plurality of closures is at least partially closing the first plurality of containers while the first plurality of containers is in the closure nest.

43. The method of claim 25, wherein the decontaminating is at least one of electron beam decontamination and ultraviolet radiation decontamination.

44. The method of claim 25, wherein the decontaminating is by means of at least one of steam and chemical exposure.

45. The method of claim 25, wherein the decontaminating the second sealed nested material comprises covering the second sealed nested material with an impermeable cover.

46. The method of claim 25, further comprising weighing the first plurality of containers while the first plurality of containers is in the container nest.

47. The method of claim 25, wherein the aseptically gripping step includes aseptically gripping a tub of the second sealed nested material.

48. The method of claim 25, wherein the aseptically gripping step includes aseptically gripping a cover of the first sealed nested material.

* * * * *